US010612475B2

(12) United States Patent
Brockley

(10) Patent No.: US 10,612,475 B2
(45) Date of Patent: Apr. 7, 2020

(54) TORQUE MODULATION FOR INTERNAL COMBUSTION ENGINE

(71) Applicant: JAGUAR LAND ROVER LIMITED, Warwickshire (GB)

(72) Inventor: Nick Brockley, Coventry (GB)

(73) Assignee: JAGUAR LAND ROVER LIMITED, Whitley, Coventry (GB)

( * ) Notice: Subject to any disclaimer, the term of this patent is extended or adjusted under 35 U.S.C. 154(b) by 0 days.

(21) Appl. No.: 15/032,125

(22) PCT Filed: Oct. 16, 2014

(86) PCT No.: PCT/EP2014/072198
§ 371 (c)(1),
(2) Date: Apr. 26, 2016

(87) PCT Pub. No.: WO2015/062871
PCT Pub. Date: May 7, 2015

(65) Prior Publication Data

US 2016/0305349 A1 Oct. 20, 2016

(30) Foreign Application Priority Data

Oct. 28, 2013 (GB) ..... 1319015.2

(51) Int. Cl.
*F02D 13/02* (2006.01)
*F01L 9/02* (2006.01)
(Continued)

(52) U.S. Cl.
CPC ..... *F02D 13/0226* (2013.01); *F01L 1/14* (2013.01); *F01L 9/025* (2013.01); *F01L 13/0031* (2013.01);
(Continued)

(58) Field of Classification Search
CPC ..... F02D 13/0226; F02D 13/0273; F02D 13/0253; F01L 9/023; F01L 1/14;
(Continued)

(56) References Cited

U.S. PATENT DOCUMENTS 4,133,332 A 1/1979 Benson et al.
4,164,917 A 8/1979 Glasson
(Continued)

FOREIGN PATENT DOCUMENTS

CN 203130181 U 8/2013
DE 4324837 A1 1/1995
(Continued)

OTHER PUBLICATIONS

Graphic Symbols for Fluid Power Diagrams—USAS Y32.10, 1967, The American Society of Mechanical Engineers, pp. 7-8.*
(Continued)

*Primary Examiner* — Mahmoud Gimie
*Assistant Examiner* — Joshua Campbell
(74) *Attorney, Agent, or Firm* — Carlson, Gaskey & Olds

(57) ABSTRACT

A method and apparatus for continually and rapidly adjusting the output torque of an engine according to a torque demand uses an active tappet to vary the instant air charge in a combustion chamber. The invention allows substantially efficient combustion throughout the engine operating map. Various methods of changing the charge of air are disclosed.

12 Claims, 1 Drawing Sheet

(51) Int. Cl.

| | |
|---|---|
| ***F02P 5/04*** | (2006.01) |
| ***F02D 37/02*** | (2006.01) |
| ***F01L 1/14*** | (2006.01) |
| ***F01L 13/00*** | (2006.01) |
| ***F02D 41/26*** | (2006.01) |
| *F02D 41/00* | (2006.01) |

(52) U.S. Cl.
CPC ..... *F02D 37/02* (2013.01); *F02D 41/26* (2013.01); *F02P 5/045* (2013.01); *F01L 13/0015* (2013.01); *F01L 2013/118* (2013.01); *F01L 2800/08* (2013.01); *F02D 13/023* (2013.01); *F02D 13/0223* (2013.01); *F02D 2041/001* (2013.01); *F02D 2250/18* (2013.01); *F02D 2250/22* (2013.01)

(58) Field of Classification Search
CPC . F01L 13/0031; F01L 13/0015; F01L 13/023; F01L 2013/118
USPC ..... 123/346, 348, 90.15
See application file for complete search history.

(56) References Cited

U.S. PATENT DOCUMENTS

| | | | | |
|---|---|---|---|---|
| 5,050,453 | A * | 9/1991 | Yamaguchi | F02D 41/083 477/107 |
| 5,709,190 | A * | 1/1998 | Suzuki | F02B 17/005 123/302 |
| 5,758,612 | A * | 6/1998 | Tsuzuku | F01L 1/143 123/198 F |
| 5,809,950 | A * | 9/1998 | Letsche | F01L 9/02 123/90.12 |
| 6,308,671 | B1 | 10/2001 | Reed et al. | |
| 6,561,145 | B1 * | 5/2003 | Stockhausen | F01L 9/02 123/198 F |
| 7,300,381 | B2 * | 11/2007 | Badillo | B60W 10/02 477/101 |
| 9,777,651 | B2 * | 10/2017 | Brockley | F02D 41/023 |
| 2001/0006058 | A1 | 7/2001 | Kawasaki et al. | |
| 2002/0086771 | A1 * | 7/2002 | Abe | B60W 10/06 477/101 |
| 2004/0134449 | A1 * | 7/2004 | Yang | F02B 1/12 123/27 R |
| 2006/0196479 | A1 * | 9/2006 | Weiss | F01L 13/0036 123/478 |
| 2007/0131196 | A1 * | 6/2007 | Gibson | F01L 1/38 123/198 F |
| 2007/0235007 | A1 | 10/2007 | Yasui et al. | |
| 2010/0168987 | A1 * | 7/2010 | De Cristoforo | F01L 9/021 701/105 |
| 2011/0073070 | A1 * | 3/2011 | Ruhland | F01N 3/101 123/406.19 |
| 2012/0138016 | A1 * | 6/2012 | Martin | F02D 37/02 123/406.23 |
| 2012/0192818 | A1 * | 8/2012 | Meldolesi | F01L 3/22 123/90.15 |
| 2012/0215419 | A1 * | 8/2012 | Kamio | F02D 13/0223 701/103 |
| 2012/0260872 | A1 * | 10/2012 | Borean | F01L 9/025 123/90.12 |
| 2013/0068197 | A1 * | 3/2013 | Daeubel | F02D 41/0052 123/406.48 |

FOREIGN PATENT DOCUMENTS

| | | | |
|---|---|---|---|
| EP | 2108800 | A1 | 10/2009 |
| EP | 2511504 | A1 | 10/2012 |
| GB | 2400689 | A | 10/2004 |
| JP | 56-141030 | A | 11/1981 |
| JP | 10-311231 | A | 11/1998 |
| JP | 2003254099 | A | 9/2003 |
| JP | 2005163667 | A | 6/2005 |
| JP | 2005201209 | | 7/2005 |
| JP | 2006132420 | A | 5/2006 |
| JP | 2009137530 | A | 6/2009 |
| JP | 2010024963 | A | 2/2010 |
| JP | 2010270605 | A | 12/2010 |

OTHER PUBLICATIONS

Graphic Symbols for Fluid Power Diagrams—USAS Y32.10, 1967, The American Society of Mechanical Engineers, pp. 7-8. (Year: 1967).*

International Search Report and Written Opinion of the International Searching Authority for International application No. PCT/EP2014/072198 dated Jan. 23, 2015.

Combined Search and Examination Report under Sections 17 and 18(3) for Application No. GB13-122GB0 dated May 23, 2014.

* cited by examiner

TORQUE MODULATION FOR INTERNAL COMBUSTION ENGINE

TECHNICAL FIELD

This invention relates to modulation of engine output torque in response to torque demand, and particularly to modulation of engine torque in a vehicle.

BACKGROUND

Historically modulation of engine output torque in a vehicle was solely by control of accelerator pedal position, which in turn usually determined the position of a throttle valve at the entrance to an air inlet manifold. The response of an engine to a change of throttle valve position is generally delayed by the volume of air in the inlet manifold (upstream of the inlet valve(s)), so that several combustion cycles may pass before output torque is modified in the intended direction. This delay is generally not noticed by vehicle drivers, or is accommodated by an alteration of driving style.

More recently aspects of air management, fuel management and combustion timing have been under the control of an electronic control unit (ECU) of the engine, so that many kinds of operating conditions can be accommodated, to the intent that the engine runs efficiently at all conditions of speed and load. In particular, torque change requests from other vehicle systems, such as chassis, transmission and braking systems, must be prioritised and acted upon. A more rapid means of modulating engine output torque was considered desirable, and as a result active variation of the timing of an ignition spark was proposed. Active control of ignition timing permits successive combustion events in an individual combustion chamber to be timed differently, and furthermore permits different combustion chambers of a multi-cylinder engine to be timed differently; this method of control is significantly more rapid than one based upon throttle valve movement.

By active control of ignition timing, a torque down request, for example during a speed ratio change, can be effected rapidly by retarding the timing of an ignition spark. Output torque is reduced, but as a result combustion is relatively inefficient. Typically additional waste heat is generated in the engine and in the engine exhaust system. Inefficient combustion may also lead to an increase in undesirable exhaust emissions.

In anticipation of a torque-up request, for example when the engine is idling, an excess of air/fuel mixture may be introduced into a combustion chamber and ignited with a retarded spark so as to produce the torque output required to achieve the desired idling speed. A rapid response to a torque-up request is achieved by advancing the timing of an ignition pulse between one combustion event and the next. However it will be appreciated that the technique also relies upon inefficient combustion, with the disadvantages noted above.

It is also known to vary operation of the inlet and/or exhaust valves to obtain a variation of the volume of air available for combustion, but such systems relying on movement of cam elements are generally considered to be slow, and about an order of magnitude slower than is provided by a variation in the timing of an ignition spark.

What is required is a means of continuous modulation of engine output torque which is capable of a response as fast as variation of ignition timing, but without the associated inefficiencies of combustion.

SUMMARY OF THE INVENTION

According to the invention there is provided a method of continual modulation of torque output of an internal combustion engine having a combustion chamber, a poppet inlet valve to said chamber and an active tappet for activating said inlet valve, the method comprising:

a) determining a torque demand, b) controlling said active tappet to provide a commensurate air charge in said combustion chamber, c) commanding substantially efficient combustion in said combustion chamber by appropriate timing of commencement of combustion, d) repeating steps a), b) and c) for each successive combustion event in said combustion chamber.

The method of the invention provides for the appropriate volume of air in the combustion chamber, so that optimum ignition timing will give for successive combustion events an output torque sufficient to meet the torque demand.

Inefficient combustion can be avoided, in particular the deliberate retarding of an ignition pulse to meet a torque-down demand, or in anticipation of a torque-up demand.

The invention may be applied to a multi-cylinder engine in which each combustion chamber is individually controlled for each successive combustion event.

The invention provides for the use of an active tappet to vary the volume and/or timing of admission of air into the combustion chamber and/or timing of the exhaust of combustion gas from the combustion chamber so as to provide the required air charge at each combustion event.

An active tappet provides for substantially immediate change of operation of the associated valve, independent of a camshaft or other valve control device, on a combustion event by combustion event basis. Such a tappet may include a hydraulic chamber whose volume is controlled by an electrically actuated valve, such as a bleed valve, responsive to a command from an engine ECU.

The air charge may be controlled by an active tappet, according to one or more of the following techniques:

varying valve lift so as to increase or decrease the maximum opening of the poppet valve during an activation cycle. If the opening and closing timing is unchanged, an increased lift will increase the volume of aspirated air, and a reduced lift will reduce the volume of aspirated air.

varying the duration of valve opening, either by re-timing valve opening, re-timing valve closing, or both. If the valve lift is unchanged, a longer open duration will tend to increase the volume of aspirated air, and a shorter duration will tend to reduce the volume of aspirated air.

varying the overlap of inlet and exhaust valves, by re-timing the opening of the inlet valve to increase or reduce overlap with operation of the exhaust valve. Reduced overlap will tend to increase the volume of air available for combustion, whereas increased overlap will tend to reduce the volume of air available for combustion.

The volume of air available for combustion may be reduced by directly reducing the volume of a fresh air charge, or by controlling valve overlap to retain a greater proportion of combustion gases within a combustion chamber; such gases are inert and cannot contribute towards combustion.

If an active tappet is also provided for an exhaust valve of the combustion chamber, valve overlap may be varied by means of the inlet valve tappet, the exhaust valve tappet, or both.

The invention permits efficient combustion whilst providing a substantially instant response to a change of torque demand. However variation of ignition timing is not excluded. Thus a small amount of ignition retardation may be commanded if the net effect is to achieve better overall conditions of combustion. A small amount of retardation (<10° crank angle) generally has only a slight effect on combustion efficiency, and may accordingly be permitted in appropriate circumstances together with a variation of air charge.

Within the scope of the this application it is expressly envisaged that the various aspects, embodiments, examples and alternatives set out in the preceding paragraphs, in the claims and/or in the following description and drawings, and in particular the individual features thereof, may be taken independently or in any combination. Features described in connection with one embodiment are applicable to all embodiments, unless such features are incompatible.

BRIEF DESCRIPTION OF DRAWINGS

Other features of the invention will be apparent from the following description of an embodiment illustrated by way of example only in the accompanying drawings in which.

DESCRIPTION OF EMBODIMENT

Figure 1:
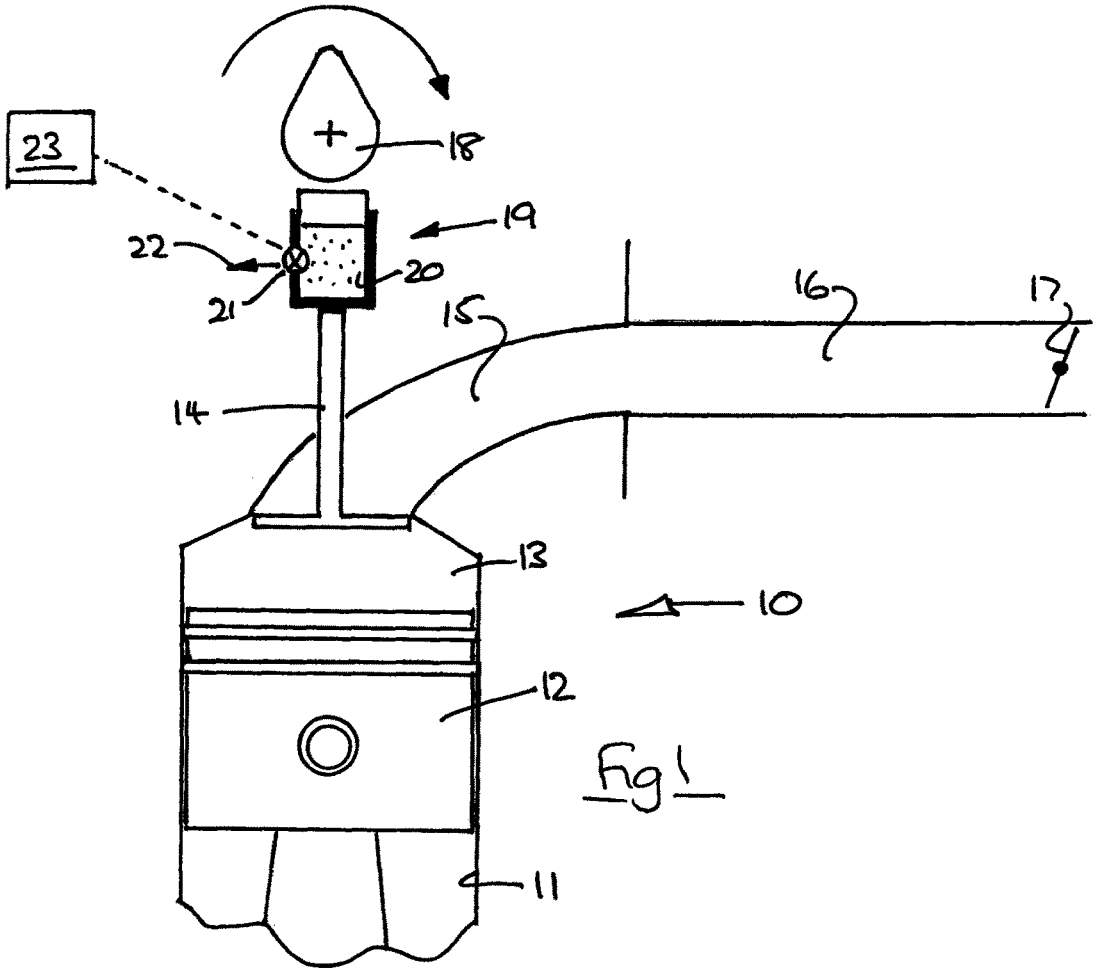
FIG. 1 shows schematically the inlet arrangement of an engine to which the present invention may be applied.

With reference to the drawings, an internal combustion engine 10 has a cylinder 11 within which a piston 12 reciprocates. A combustion chamber 13 is defined above the piston, and contains a poppet valve 14 which is opened to admit air from an inlet port 15. The inlet port is fed from an inlet manifold 16, at the mouth of which is provided a throttle valve 17.

The poppet valve 14 is closed by a spring (not shown), and is opened by action of a rotatable cam 18 which is conventionally provided by a lobe of a camshaft. Between the cam 18 and the valve 14 is provided a tappet 19.

The general arrangement of FIG. 1 is very common, and for ease of illustration certain other components, such as a corresponding poppet exhaust valve, are not illustrated. Conventionally the tappet 19 is solid, and may be characterized as passive.

The tappet of FIG. 1 is however active, and is characterized by a hydraulic chamber 20 whose volume is determined according to opening and closing of a bleed valve 21 which allows escape of fluid as indicated by arrow 22. The chamber 20 receives a constant supply of oil under pressure, and by varying the opening of the bleed valve over time, the instant volume of oil in the chamber can be changed to affect the lift, duration and timing of the operation of the inlet valve. It will be understood that the active tappet may enhance, oppose or neutralize the effect of the cam 18. The kind of active tappet is not important save that it should permit fast variation of valve lift on an event basis. Thus it is envisaged that valve lift may be varied at each successive opening thereof, if required, for each cylinder of a multi-cylinder engine.

One example of an active tappet is disclosed in EP-A-2511504, and relies upon an electro-hydraulic device. Command of the active tappet is by an ECU 23.

Multiple inlet valves may be provided for the or each cylinder, and one or more such valves may be actuated by an active tappet, as required.

In use the admission of air into the engine is generally controlled via the throttle valve 17, which in turn is commanded by the ECU 23 according to conventional control parameters such as accelerator pedal position, altitude, air temperature and the like. It will be understood an alteration of the position of the throttle valve 17 changes the rate of air inflow, but does not immediately influence the amount of air admitted to the combustion chamber because of the air volume contained in the inlet manifold 16 and inlet tract 15.

In a prior art method of responding to a change of torque demand, the inlet valve lift is determined by a fixed length tappet (i.e. a passive tappet), and the timing of valve opening and closing by the profile of the cam 18.

Air flow through the engine may be greater than required to generate the torque demanded, but the torque generated is reduced by retarding the ignition timing.

This prior technique is particularly applicable at engine idling speed, where a torque-up demand can be expected.

In response to a torque-up demand, ignition timing is advanced. In consequence combustion becomes more efficient, as the ignition timing approaches the optimum. Ignition timing can be varied very quickly, and accordingly the response of the engine to the increased demand for torque is rapid (within one TDC).

It will be understood that in this simplified explanation of the prior technique, certain control aspects are not fully considered. For example it is assumed that engine torque can be precisely controlled according to the illustration whereas in practice it may vary slightly and continuously within upper and lower limits. Ignition timing is generally varied on a cylinder by cylinder basis to achieve a fast response to a torque-up demand, but with the risk of combustion inefficiency.

In the invention, by virtue of the active tappet, whereby for example valve lift is substantially reduced to restrict the volume of air admitted to the cylinder, the air charge is commensurate with the torque demand if combusted substantially at full efficiency. Ignition timing has sufficient advance to ensure substantially efficient combustion. For an increase in torque demand, the valve lift may be increased to enlarge the air charge.

Cumulative exhaust emissions, absent any other consideration, rise at a reduced rate by virtue of operation of the active tappet with lower fuel consumption (because of reduced air charge at torque-down or in anticipation of torque-up) and reduced exhaust emissions.

Adjustment of valve lift is very rapid, and the response is commensurate with the response of a variation in ignition timing. The response time is fast enough to meet the required specification, and generally about an order of magnitude better than a response based on prior methods of adjusting valve operation or of adjusting a throttle valve.

As a consequence of an increase in valve lift, the aspiration of air into the engine is increased, so that greater torque results from combustion. Ignition timing may be retarded slightly to ensure optimum combustion. Operation of successive inlet valves may be individually varied to ensure a smooth rapid torque change.

In a multi-cylinder engine, active tappets are provided on inlet valves of each cylinder and are activated independently. Accordingly cylinder by cylinder adjustment is possible so that torque output may track demand very closely. The air charge permitted by operation of successively opening inlet valves may be different to permit a ramping-up and rampingdown of the effect of the invention, according to known methods of hysteresis control.

Inefficient combustion by deliberate retardation of ignition timing, inevitably introduces additional waste heat to the engine cooling system, which typically relies upon liquid coolant and a coolant/air radiator.

The efficient combustion of the invention provides a reduced amount of waste heat, with the consequence that volume of the coolant and the coolant air radiator may be comparatively smaller.

The use of active inlet valve tappets on one or more inlet valves of each cylinder of an internal combustion engine can be used alone to ensure a fast response to a torque-up and torque-down demand. However additional variation of ignition timing to ensure spark optimisation and ignition efficiency may also be a useful technique.

Figure 2:
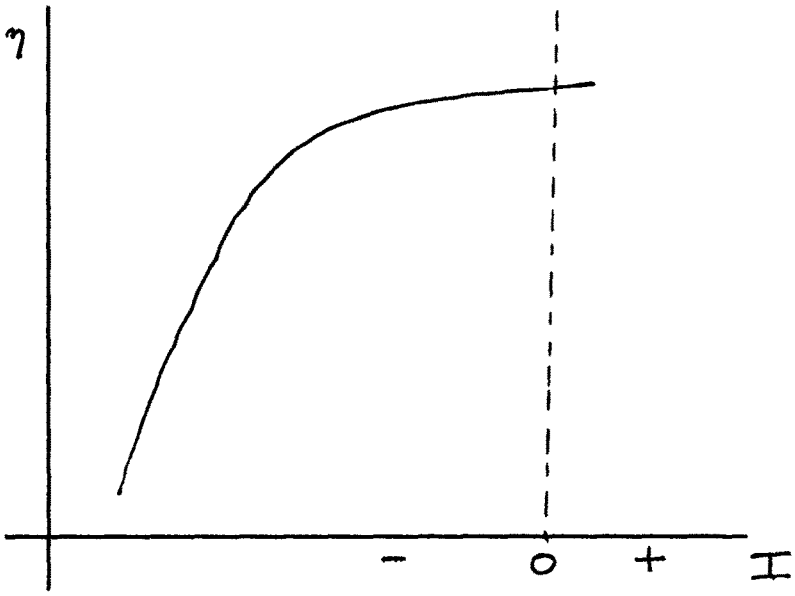
FIG. 2 illustrates graphically a relationship between ignition timing and combustion efficiency.

FIG. 2 illustrates that combustion efficiency does not fall linearly with spark retardation. Efficiency (q) is plotted against ignition timing I with the zero point indicating spark timing for optimum combustion; to the left of the zero point ignition timing is retarded (−), and to the right ignition timing is advanced (+).

It will be observed that initially, retarding of ignition timing has relatively little effect upon efficiency of combustion, and accordingly a combination of adjustment of ignition timing and use of an active tappet is available for controlling torque output within a narrow band. The amount of permissible retardation will change according to the particular engine and the load/speed operating map thereof, but may be less than 15°, or less than 10°, or less than 5°.

Admission of fuel to the cylinders is not described above, but known methods may be employed to ensure that fuel admission is commensurate with the air charge, so as to achieve substantially stoichiometric combustion. For example the ECU 23 may command an injection of fuel commensurate with the air charge commanded via the bleed valve 21.

The foregoing example describes a variation of valve lift to vary the volume of air admitted via the inlet valve 14; duration of valve opening is determined by the profile of the cam 18.

However it will be understood that the bleed valve may be used to counter or enhance the action of the cam by for example delaying valve opening and valve closing. In one example fluid may be allowed to bleed from the chamber to precisely counteract the lifting effect of the cam.

It will thus be understood that the volume of air admitted into the cylinder may additionally, or alternatively, be varied by changing the duration of valve opening, and/or by changing the timing of valve opening and of valve closing.

The invention is typically used for a vehicle engine, though application to non-vehicle installations is also envisaged.

Furthermore, in a practical vehicle installation, it is envisaged that the possibility of substantial variation of ignition timing will be retained, not only to allow efficient combustion throughout the range of engine speed, but also to provide redundancy in case of an error or fault relating to the active tappet or to the control system thereof.

Variations are possible, and the invention is not limited to the example described above, but only by the scope of the claims appended hereto.

Aspects of the invention will be apparent from the numbered paragraphs that follow:

1. A method of continual modulation of torque output of an internal combustion engine having a combustion chamber, a poppet inlet valve to said chamber and an active tappet for activating said inlet valve, the method comprising:

a) determining a torque demand, b) controlling said active tappet to provide a commensurate air charge in said combustion chamber, c) commanding substantially efficient combustion in said combustion chamber by appropriate timing of commencement of combustion, d) repeating steps a), b) and c) for each successive combustion event in said combustion chamber.

2. A method according to aspect 1 applied to a spark ignition engine, the timing of commencement of combustion being determined by an ignition spark.

3. A method according to aspect 2 and including the step of adjusting the timing of an ignition spark to provide for substantially efficient combustion.

4. A method according to aspect 3 wherein a response to torque down demand includes: retarding the timing of an ignition spark by less than 10°.

5. A method according to aspect 3 wherein a response to torque up demand includes:

increasing the air charge to said combustion chamber, and advancing the timing of an ignition spark.

6. A method according to aspect 1 wherein a commensurate air charge is provided by one of more of:

changing the lift of said tappet, changing the duration of opening of said inlet valve by control of said tappet, changing the timing of opening of said inlet valve by control of said tappet, changing the timing of closing of said inlet valve by control of said tappet, changing the overlap of said inlet valve and an exhaust valve of said combustion chamber, by control of said tappet.

7. A method according to aspect 1 wherein said active tappet permits a variation of an immediately succeeding valve opening in consequence of a determination of a change in torque demand after a preceding valve opening.

8. A method of aspect 1 wherein said active tappet comprises a hydraulic chamber having an electrically commanded valve to vary the instant volume thereof.

9. A method according to aspect 8, wherein said hydraulic chamber is provided with a substantially unobstructed inlet flow of liquid oil, and includes a solenoid controlled bleed valve to vary outlet flow therefrom.

10. A method of aspect 1 applied to a multi-cylinder engine having an active tappet for an inlet valve of each cylinder thereof.

11. A method according to aspect 10, wherein each active tappet is independently commanded by an electronic control unit of said engine to change the air charge of a respective cylinder for successive combustion events in that cylinder.

12. A control system for implementing the method of any of aspects 1 to 11, said control system comprising an electronic control unit having a processor for electronically commanding said active tappet according to a torque demand parameter contained in a memory of said processor.

13. A reciprocating piston gasoline engine having a plurality of cylinders, an inlet valve for each cylinder and an active tappet for each said inlet valve, said engine being adapted for operation according to the method of any of aspects 1 to 11.

14. A vehicle incorporating the engine of aspect 13, and an electronic control system for implementing the method.

The invention claimed is:

1. A method of continuous modulation of torque output of a multi-cylinder internal combustion engine, each cylinder having a combustion chamber, at least one inlet valve for each combustion chamber and an active tappet for each inlet valve for activating a respective said inlet valve, the method comprising:

for each successive combustion event in said combustion chamber a) determining a change of torque demand relative to an immediately preceding combustion event, b) controlling said active tappet to provide a change of air charge in a respective said combustion chamber in dependence on each change of torque demand relative to the immediately preceding combustion event, said change of air charge being commensurate to said change of torque demand relative to the immediately preceding combustion event, wherein if the change of torque demand is an increase said active tappet is controlled to increase the air charge and if the change of torque demand is a decrease said active tappet is controlled to decrease the air charge, wherein each active tappet is individually commanded by an electronic control unit of said internal combustion engine to change a charge of air available for combustion in a respective cylinder on a combustion event by combustion event basis, wherein said active tappet is controlled to increase the air charge to said combustion chamber at least by increasing valve lift when said change of torque demand is an increase of torque demand, to cause, in part, the torque output of the internal combustion engine to increase to continuously track said increase of torque demand, and c) commanding a selected type of combustion appropriate to said air charge in said combustion chamber by adjustment of timing of commencement of combustion, wherein a timing of an ignition spark is advanced when the change of torque demand is an increase of torque demand, to speed up an increase in the torque output to track said increase of torque demand.

2. A method according to claim 1, including retarding the timing of the ignition spark by less than 10° when the change of torque demand is a decrease.

3. A method according to claim 1, wherein said change of air charge is provided by one or more of:

changing a lift of said tappet, changing a duration of opening of said inlet valve by control of said tappet, changing a timing of opening of said inlet valve by control of said tappet, changing a timing of closing of said inlet valve by control of said tappet, changing an overlap of said inlet valve and an exhaust valve of said combustion chamber, by control of said tappet.

4. A method according to claim 1, wherein said active tappet permits a variation of an immediately succeeding valve opening in consequence of a determination of a change in torque demand after a preceding valve opening.

5. A method of claim 1, wherein said active tappet comprises a hydraulic chamber having an electrically commanded valve to vary an instant volume of the hydraulic chamber.

6. A method according to claim 5, wherein said hydraulic chamber is provided with an unobstructed inlet flow of liquid oil, and the electrically commanded valve is a solenoid controlled bleed valve to vary outlet flow from said hydraulic chamber.

7. A control system, comprising:

an electronic control unit having a processor and a memory associated with the processor, the processor being configured for electronically commanding an active tappet of an inlet valve of a cylinder of an engine according to a torque demand parameter contained in the memory, the cylinder having a combustion chamber, the processor being configured for continuous modulation of torque output of the engine, comprising for each successive combustion event in said combustion chamber:

a) determining a change of torque demand relative to an immediately preceding combustion event, b) controlling said active tappet to provide a change of air charge in said combustion chamber in dependence on each change of torque demand relative to the immediately preceding combustion event, said change of air charge being commensurate to said change of torque demand relative to the immediately preceding combustion event, wherein if the change of torque demand is an increase said active tappet is controlled to increase the air charge and if the change of torque demand is a decrease said active tappet is controlled to decrease the air charge, wherein the active tappet is individually commanded by the electronic control unit to change a charge of air available for combustion in the cylinder on a combustion event by combustion event basis, wherein said active tappet is controlled to increase the air charge to said combustion chamber at least by increasing valve lift when said change of torque demand is an increase of torque demand, to cause, at least in part, the torque output of the internal combustion engine to increase to continuously track said increase of torque demand, and c) commanding a selected type of combustion appropriate to said air charge in said combustion chamber by adjustment of timing of commencement of combustion, wherein a timing of an ignition spark is advanced when the change of torque demand is an increase of torque demand to speed up an increase in the torque output to track said increase of torque demand.

8. A reciprocating piston gasoline engine, comprising:

a plurality of cylinders, each cylinder having a combustion chamber;

an inlet valve for each cylinder; and an active tappet for each said inlet valve, said engine being adapted for operation according to a method of continuous modulation of torque output of the engine, the method comprising:

for each successive combustion event in said combustion chamber:

a) determining a change of torque demand relative to an immediately preceding combustion event, b) controlling said active tappet to provide a change of air charge in a respective said combustion chamber in dependence on each change of torque demand relative to the immediately preceding combustion event, said change of air charge being commensurate to said change of torque demand relative to the immediately preceding combustion event, wherein if the change of torque demand is an increase said active tappet is controlled to increase the air charge and if the change of torque demand is a decrease said active tappet is controlled to decrease the air charge, wherein each active tappet is individually commanded by an electronic control unit of said engine to change a charge of air available for combustion in a respective cylinder on a combustion event by combustion event basis, wherein said active tappet is controlled to increase the air charge to said combustion chamber at least by increasing valve lift when said change of torque demand is an increase of torque demand to cause, in part, the torque output of the engine to increase to continuously track said increase of torque demand, and c) commanding a selected type of combustion appropriate to said air charge in said combustion chamber by adjustment of timing of commencement of combustion, wherein a timing of an ignition spark is advanced when the change of torque demand is an increase of torque demand to speed up an increase in the torque output to track said increase of torque demand.

9. A vehicle incorporating the engine of claim 8, and an electronic control system for implementing the method.

10. A method according to claim 1, wherein the change of torque demand is a torque down demand; and the adjustment of timing of commencement of combustion comprises retarding the timing of commencement of combustion relative to a timing for most efficient combustion, by less than an amount of permissible retardation.

11. A method according to claim 1, including retarding the timing of commencement of combustion by less than an amount of permissible retardation that depends upon a particular variant of the engine and an engine load/speed operating map when the change of torque demand is a decrease.

12. A method according to claim 2, wherein retardation of the timing of the ignition spark is permitted by more than 10° in response to an error or fault relating to the active tappet or to a control system for implementing the method.

* * * * *